US009537242B2

(12) United States Patent
Chen

(10) Patent No.: US 9,537,242 B2
(45) Date of Patent: Jan. 3, 2017

(54) ELECTRICAL POWER CONNECTOR AND A TERMINAL ASSEMBLY

(71) Applicant: OUPIIN ELECTRONIC (KUNSHAN) CO., LTD, Kunshan (CN)

(72) Inventor: Hsin Chih Chen, Kunshan (CN)

(73) Assignee: OUPIN ELECTRONIC (KUNSHAN) CO., LTD, Kunshan (CN)

( * ) Notice: Subject to any disclaimer, the term of this patent is extended or adjusted under 35 U.S.C. 154(b) by 0 days.

(21) Appl. No.: 14/936,701

(22) Filed: Nov. 10, 2015

(65) Prior Publication Data

US 2016/0226177 A1 Aug. 4, 2016

(30) Foreign Application Priority Data

Jan. 29, 2015 (CN) ..... 2015 2 0061283 U

(51) Int. Cl.
*H01R 12/00* (2006.01)
*H01R 13/18* (2006.01)

(52) U.S. Cl.
CPC ..... *H01R 13/18* (2013.01)

(58) Field of Classification Search
CPC ... H01R 23/7073; H01R 13/53; H01R 23/688; H01R 13/64; H01R 23/725; H01R 31/02; H01R 23/722; H01R 23/7068
USPC ..... 439/79, 181, 607.08, 607.09, 660, 677,439/682, 907, 908, 924.1, 947
See application file for complete search history.

(56) References Cited

U.S. PATENT DOCUMENTS 6,322,377 B2 * 11/2001 Middlehurst ..... 439/79
6,383,039 B1 * 5/2002 Yoneyama ..... H01R 12/716 439/682
6,394,818 B1 * 5/2002 Smalley, Jr. ..... H01R 12/7088 439/181
7,425,145 B2 * 9/2008 Ngo ..... H01R 12/7088 439/290
7,476,108 B2 * 1/2009 Swain ..... G06F 1/20 439/487
7,726,982 B2 * 6/2010 Ngo ..... H01R 13/42 439/206
8,366,458 B2 * 2/2013 Ngo ..... H01R 12/724 439/79
8,414,336 B2 * 4/2013 Yu ..... H01R 4/30 439/660
8,574,015 B2 * 11/2013 Tai ..... H01R 13/02 439/682

(Continued)

*Primary Examiner* — Thanh Tam Le
(74) *Attorney, Agent, or Firm* — Mark M. Friedman

(57) ABSTRACT

An electrical power connector and a terminal assembly are disclosed. The electrical power connector includes a base and at least two terminal assemblies being symmetrically mounted in the base. Each terminal assembly includes a conductive terminal and a reinforcing terminal. The conductive terminal has a plate-shaped main body, a flexible engaging portion and a mounting end. The reinforcing terminal has an upright portion, an L-shaped pressing portion and an U-shaped latching portion. The upright portion is attached to one side of the plate-shaped main body of the conductive terminal, the latching portion is located at the other side of the plate-shaped main body, and the pressing portion presses the flexible engaging portion. The electrical power connector of the present invention employs the two terminal assemblies having high conductivity and good elastic to provide a better electrical performance and a long term reliable connection.

10 Claims, 8 Drawing Sheets

(56) References Cited

U.S. PATENT DOCUMENTS

| | | | | |
|---|---|---|---|---|
| 8,602,796 | B2 * | 12/2013 | Chin | H01R 13/055 439/79 |
| 8,662,913 | B2 * | 3/2014 | Tai | H01R 13/50 439/345 |
| 8,696,390 | B2 * | 4/2014 | Tai | H01R 13/115 439/660 |
| 9,136,645 | B1 * | 9/2015 | Yu | H01R 12/7088 |

* cited by examiner

ELECTRICAL POWER CONNECTOR AND A TERMINAL ASSEMBLY

BACKGROUND OF THE INVENTION

1. Field of the Invention

The present invention relates to a connector technology, and more particularly to an electrical power connector and a terminal assembly used in the electrical power connector.

2. Description of the Prior Art

The characteristics of a new electrical power connector on the current market are high rated current and low energy loss. The design of an elastic arm is used in a terminal of the electrical power connector for providing an adequate and reliable contact to fit the deviation of the size or the position. Usually, in order to improve the electrical conductivity of the elastic arm, the elasticity of the elastic arm is reduced. But this is not good for the reliable connection and frequent insertion between the electrical power connector a butt connector. On the contrary, if the elasticity of the elastic arm is greater, the contact force and the electrical conductivity between the electrical power connector and the butt connector become worse, so that the prior electrical power connector can not meet the application of high current.

Moreover, the prior electrical power connector generally includes only one terminal having an integral structure. This terminal can only act as a positive electrode or a negative electrode of a power supply, so the prior electrical power connector can only be used to transfer an unidirectional current. The application of the prior electrical power connector is limited.

Hence, it is needed to provide a new electrical power connector, which has a wide range of application, a good electrical performance and a reliable connection, and also provide a terminal assembly with high electrical conductivity and high elasticity.

BRIEF SUMMARY OF THE INVENTION

A primary object of the present invention is to provide an electrical power connector, which employs a terminal assembly with high electrical conductivity and high elasticity, for providing a better electrical performance and a long term reliable connection.

Another object of the present invention is to provide a terminal assembly with high electrical conductivity and high elasticity for providing a better electrical performance and a long term reliable connection.

The other object and the advantage of the present invention may be further understood from the technical features disclosed by the present invention.

To achieve the above object of the present invention, the present invention adopts the following technical solution.

The present invention provides an electrical power connector, which comprises a base and at least two terminal assemblies. The base includes an engaging portion located at the front thereof, a mounting portion located at the rear thereof, an upright insertion opening formed on the engaging portion, and two terminal-receiving passages symmetrically located on two sides of the insertion opening to be communicated with the insertion opening and extend to a rear surface of the mounting portion. The two terminal assemblies are symmetrically mounted in the corresponding terminal-receiving passages of the base. Each terminal assembly includes a conductive terminal and a reinforcing terminal. The conductive terminal has a plate-shaped main body, a flexible engaging portion bended from a front edge of the plate-shaped main body and extending forward, and a mounting end located at a lower edge of the plate-shaped main body. The plate-shaped main body is mounted in the mounting portion, the flexible engaging portion is inserted into the insertion opening from the corresponding terminal-receiving passage, and the mounting end extends out of a bottom surface of the base from the corresponding terminal-receiving passage. The reinforcing terminal has art upright portion, a pressing portion bended from a front edge of the upright portion and extending forward, and a latching portion bended from a rear edge of the upright portion. The upright portion is attached to one side of the plate-shaped main body of the conductive terminal, the latching portion is located at the other side of the plate-shaped main body of the conductive terminal, and the pressing portion presses the flexible engaging portion of the conductive terminal.

In one embodiment, the base further includes two cross beams, which are symmetrically located on the two sides of the insertion opening and are separately disposed in the corresponding terminal-receiving passages to divide the corresponding terminal-receiving passages into upper and lower parts; and each cross beam includes a front section located at the engaging portion and extending to a front surface of the engaging portion, a rear section located at the mounting portion, and two shoulders formed on left and right skies of the rear section.

In one embodiment, the flexible engaging portion of the conductive terminal includes two pairs of elastic pieces, which are spaced upper and lower and extend forward and each of which has an inclined extension part bended toward the other conductive terminal from the front edge of the plate-shaped main body, an arc protruding part bended far away the other conductive terminal from the inclined extension part, and a tail part being far away the other conductive terminal; and the two pairs of the elastic pieces separately enter from upper and lower sides of the cross beam into the engaging portion of the base.

In one embodiment, the plate-shaped main bodies of the two conductive terminals are arranged in parallel; the tail parts of the two conductive terminals constitute a trumpet shape; the arc protruding parts of the two conductive terminals constitute a converged shape and form a space therebetween; and the pressing portions of the two reinforcing terminals clamp the arc protruding parts of the two conductive terminals.

In one embodiment, the latching portion is U shaped to surround the rear section of the cross beam; and the pressing portion is L shaped and includes two L-shaped plates, which are spaced upper and lower and extend forward, and each of which has an extension arm bended toward the conductive terminal from the front edge of the upright portion, an end part vertically pointing at the conductive terminal, and a tip formed on the end part; the end part presses a concave side of the arc protruding part of the conductive terminal.

In one embodiment, the reinforcing terminal further includes two catching portions, which are vertically bended from the rear edge of the upright portion and are symmetrically located on upper and lower sides of the latching portion.

In one embodiment, the base further includes two retaining arms, which are symmetrically disposed at the bottom surface of the mounting portion and each of which has a fixed end and a free end; the fixed end is fixed on the base, and the free end horizontally extends toward the rear surface of the mounting portion and forms to be hook-shaped. Each conductive terminal further includes a notch, which is formed on a rear edge of the plate-shaped main body and located near the mounting end; and the free ends of the two retaining arms of the base are engaged with the corresponding notches of the conductive terminals.

In one embodiment, the base further includes two holding grooves, which are symmetrically disposed at the mounting portion and separately located on side walls of the two terminal-receiving passages and near top walls thereof. The conductive terminal further includes a horizontal holding plate bended toward outside from an upper edge of the plate-shaped main body; and the horizontal holding plate is held in the corresponding holding groove.

In one embodiment, a front surface of the engaging portion is perpendicular to the bottom surface of the mounting portion; the insertion opening extends rearward from the front surface of the engaging portion and passes though upper and lower surface of the engaging surface; each terminal-receiving passage passes through the front surface of the engaging portion and the rear surface of the mounting portion; and the base further includes at least two windows, which are located on the two sides of the insertion opening; and the insertion opening is communicated with the terminal-receiving passages by the two windows.

The present invention also provides a terminal assembly, which is applied to an electrical power connector and comprises a conductive terminal and a reinforcing terminal. The conductive terminal has a plate-shaped main body, a flexible engaging portion bended from a front edge of the plate-shaped main body and extending forward, and a mounting end located at a lower edge of the plate-shaped main body. Wherein the flexible engaging portion includes two pairs of elastic pieces, which are spaced upper and lower and extend forward. Each elastic piece at least has an inclined extension part bended toward one side of the elastic piece from the front edge of the plate-shaped main body, an arc protruding part bended toward the other side thereof from the inclined extension part, and a tail part. The reinforcing terminal has an upright portion, an L-shaped pressing portion bended from a front edge of the upright portion and extending forward, and an U-shaped latching portion bended from a rear edge of the upright portion. Wherein the L-shaped pressing portion includes two L-shaped plates, which are spaced upper and lower and extend forward; and each L-shaped plate has an extension arm bended toward the conductive terminal from the front edge of the upright portion, and an end part vertically pointing at the conductive terminal. Wherein the upright portion is attached to one side of the plate-shaped main body of the conductive terminal, the latching portion is located at the other side of the plate-shaped main body of the conductive terminal, and the end part presses a concave side of the arc protruding part of the conductive terminal.

In comparison with the prior art, the electrical power connector of the present invention employs two terminal assemblies having high conductivity and good elastic to provide a better electrical performance and a long term reliable connection. Moreover, because the electrical power connector employs two separate terminal assemblies, which can use two kinds of different polarity currents, to expand the use range of the electrical power connector.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "top", "bottom", "front", "back", "left", "right", "top", "bottom" etc., are only used with reference to the orientation of the accompanying drawings. Therefore, the used directional terms are intended to illustrate, but not to limit, the present invention.

Figure 1:
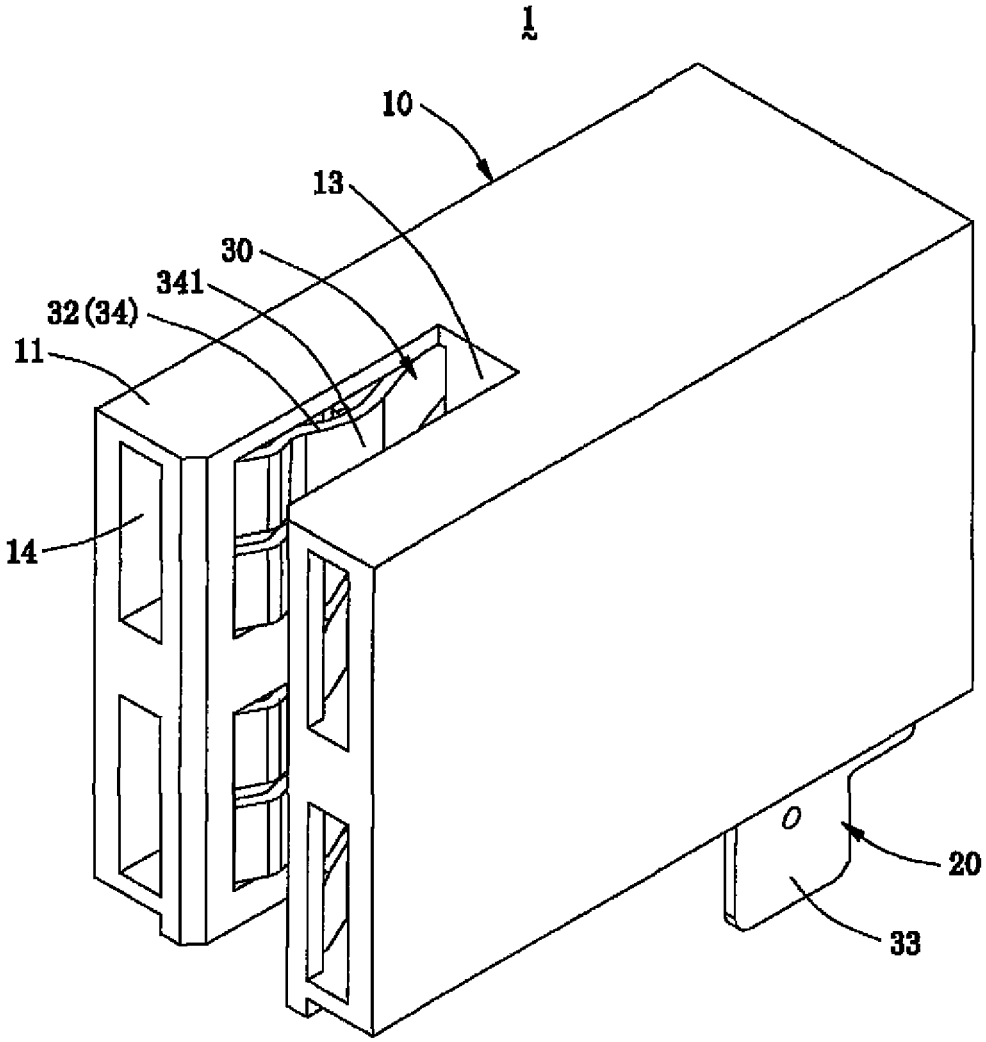
FIG. 1 is a perspective schematic view of an electrical power connector of the present invention.
Figure 2:
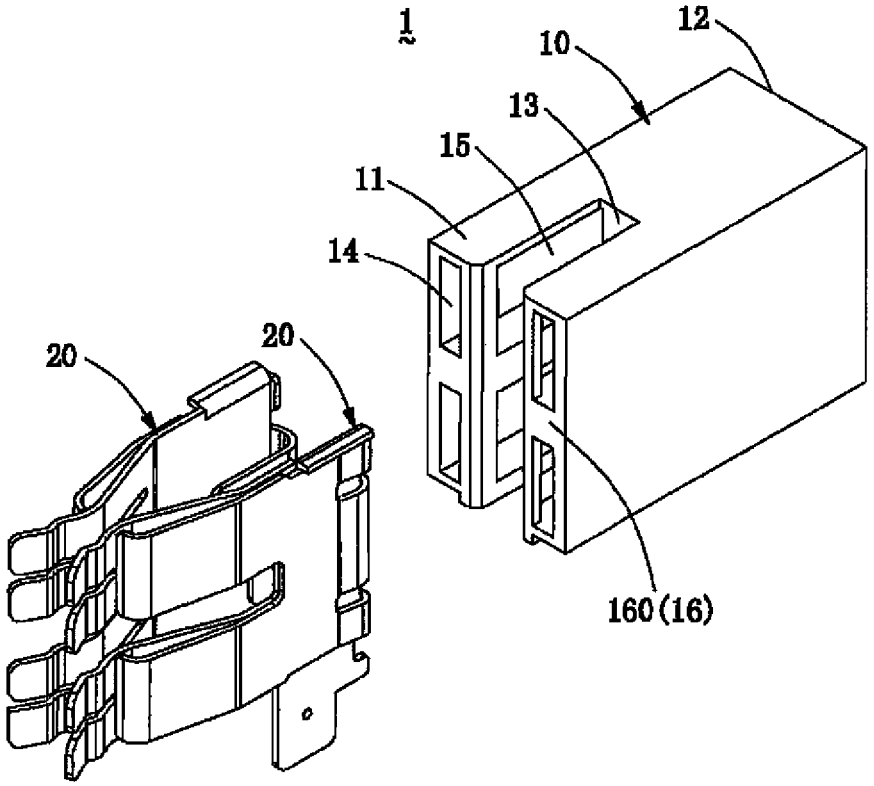
FIG. 2 is an exploded view of the electrical power connector shown by FIG. 1.
Figure 3:
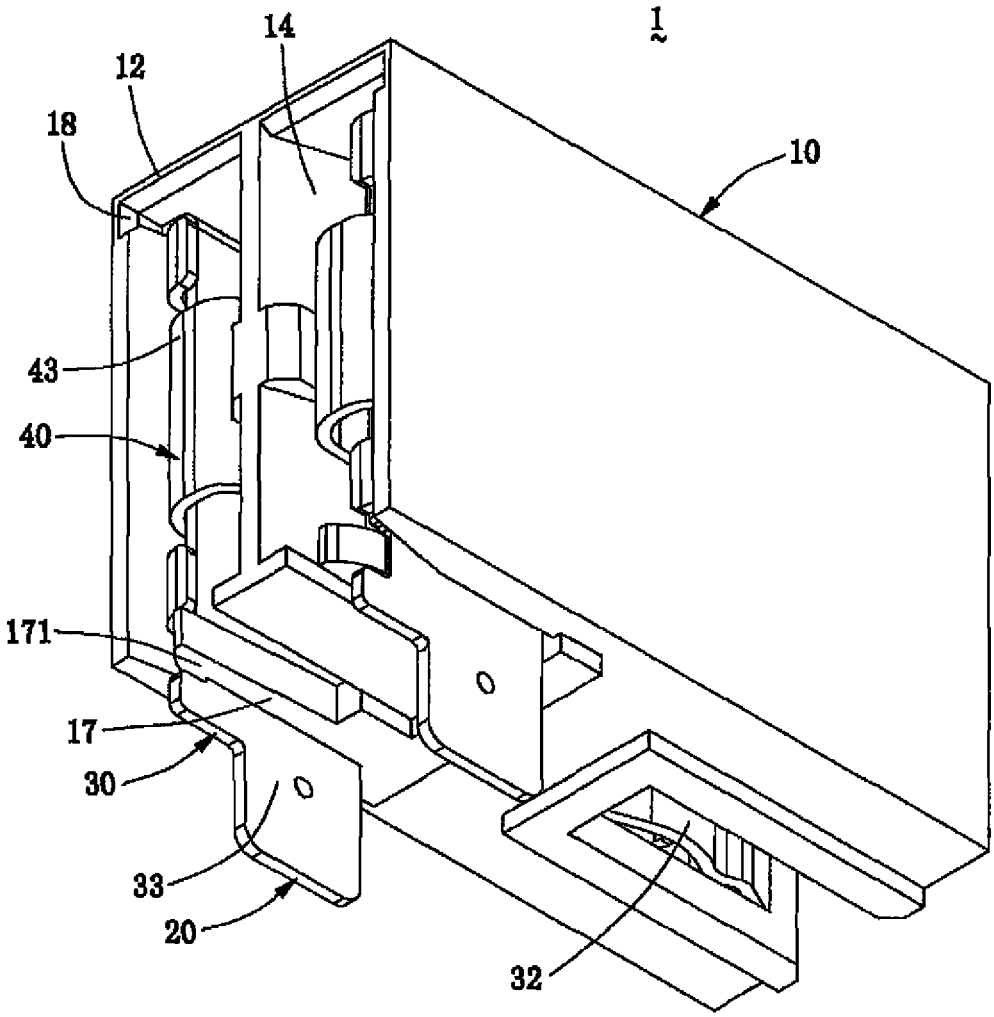
FIG. 3 is a perspective schematic view of the electrical power connector of the present invention in another direction.
Figure 4:
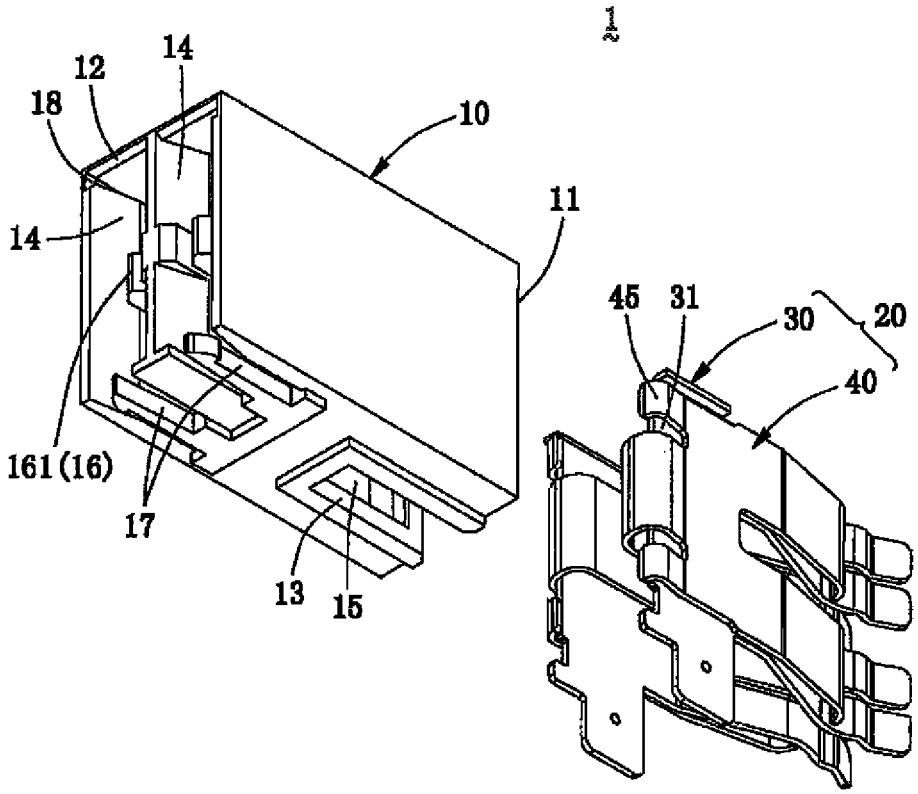
FIG. 4 is an exploded view of the electrical power connector shown by FIG. 3.
Figure 5:
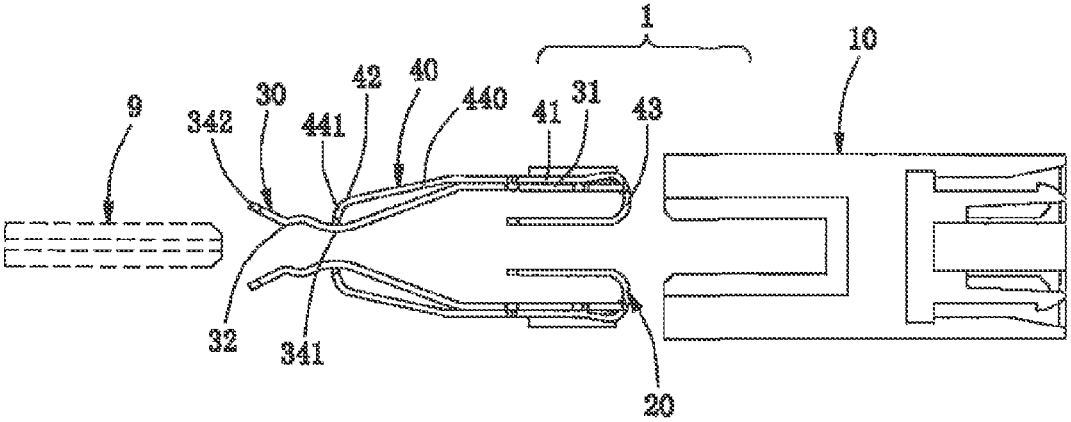
FIG. 5 is a schematic view of a planar structure after disassembling the electrical power connector of the present invention, wherein the dotted part indicates a butt connector.

Please refer to FIGS. 1 to 5, FIG. 1 is a perspective schematic view of an electrical power connector 1 of the present invention; FIG. 2 is an exploded view of the electrical power connector 1 shown by FIG. 1; FIG. 3 is a perspective schematic view of the electrical power connector 1 of the present invention in another direction; FIG. 4 is an exploded view of the electrical power connector 1 shown by FIG. 3; and FIG. 5 is a schematic view of a planar structure after disassembling the electrical power connector 1 of the present invention, wherein the dotted part indicates a butt connector.

Please refer to FIGS. 1 to 5, the electrical power connector 1 of the present invention comprises a base 10 and at least two terminal assemblies 20 symmetrically mounted on the base 10.

Please refer to FIGS. 2 and 4, the base 10 is generally rectangular. The base 10 includes an engaging portion 11 located at the front thereof, a mounting portion 12 located at the rear thereof, an upright insertion opening 13 formed on the engaging portion 11, and two terminal-receiving passages 14, which are symmetrically located on left and right sides of the insertion opening 13, are communicated with the insertion opening 13 and extend to a rear surface of the mounting portion 12. In this embodiment, a front surface of the engaging portion 11 is perpendicular to a bottom surface of the mounting portion 12. The insertion opening 13 extends rearward from the front surface of the engaging portion 11, and the length of the backward extension is substantially close to the half length of the base. The insertion opening 13 passes through upper and lower surfaces of the engaging portion 11. Each terminal-receiving passage 14 passes through the front surface of the engaging portion 11 and the rear surface of the mounting portion 12. Specifically, the base 10 also includes at least two windows 15 located on the left and right sides of the insertion opening 13. Therefore, the insertion opening 13 can be communicated with the two terminal-receiving passages 14 located on the two sides thereof.

Please refer to FIGS. 2 and 4, the base 10 also includes two cross beams 16, which are symmetrically located on the left and right sides of the insertion opening 13 and are separately disposed in the corresponding terminal-receiving passages 14 to divide the corresponding terminal-receiving passages 14 into upper and lower parts. In this embodiment, each cross beam 16 includes a front section 160 located at the engaging portion 11 and extending to the front surface of the engaging portion 11, a rear section 161 located at the mounting portion 12, and two shoulders 162 (shown in FIG. 6) formed on left and right sides of the rear section 161.

Figure 6:
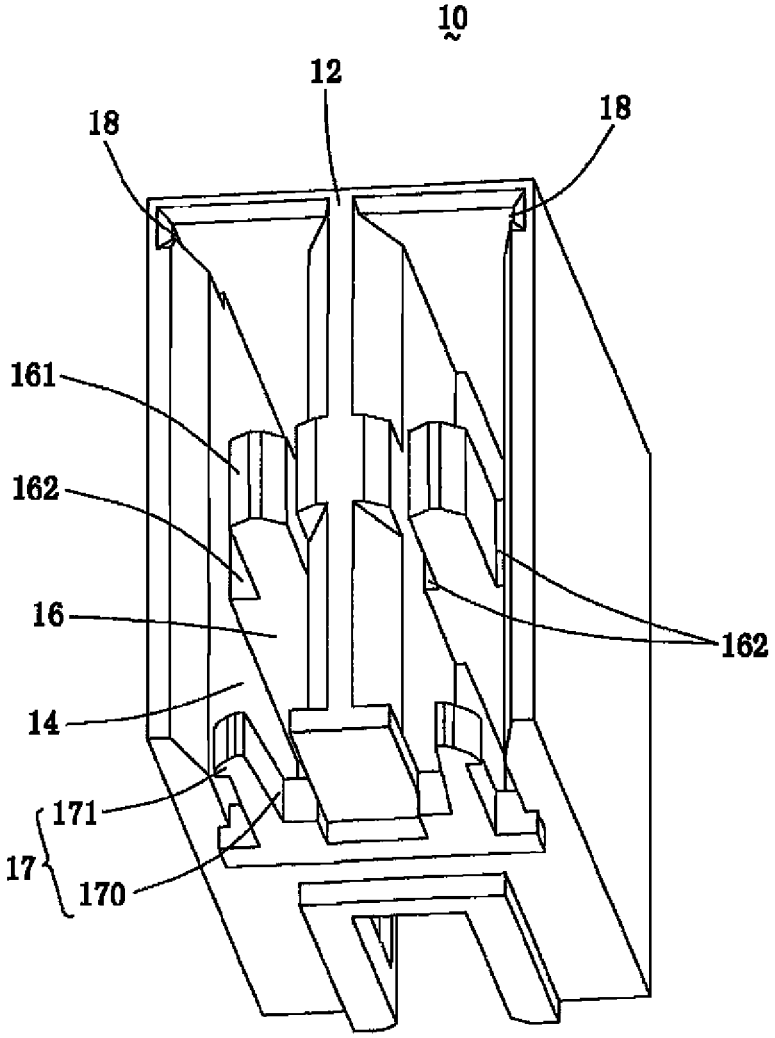
FIG. 6 is a perspective schematic view of a housing of the electrical power connector of the present invention.

Please refer to FIGS. 4 and 6, the base 10 also includes two retaining arms 17, which are symmetrically disposed at the bottom surface of the mounting portion 12. Each retaining arm 17 is located under the corresponding terminal-receiving passage 14. The retaining arm 17 has a fixed end 170 and a free end 171. The fixed end 170 is fixed on the base 10, and the free end 171 horizontally extends toward the rear surface of the mounting portion 12 and forms to be hook-shaped. The hook-shaped free ends 171 of the two retaining arms 17 are located back-to-back and face toward outside.

Please refer to FIGS. 4 and 6, the base 10 further includes two holding grooves 18, which are symmetrically disposed at the mounting portion 12 and separately located on side walls of the two terminal-receiving passages 14 and near top walls thereof.

Figure 7:
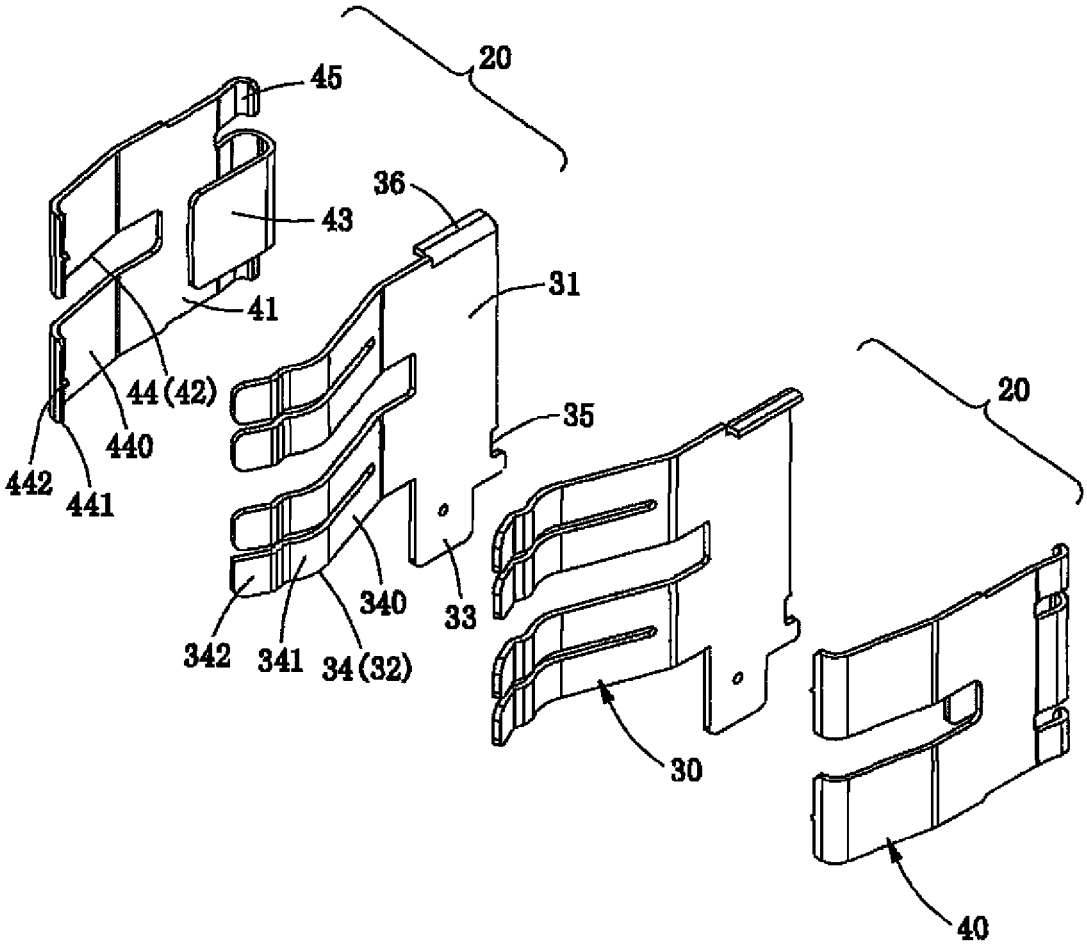
FIG. 7 is a perspective schematic view of a terminal assembly shown in FIG. 2 after disassembling.
Figure 8:
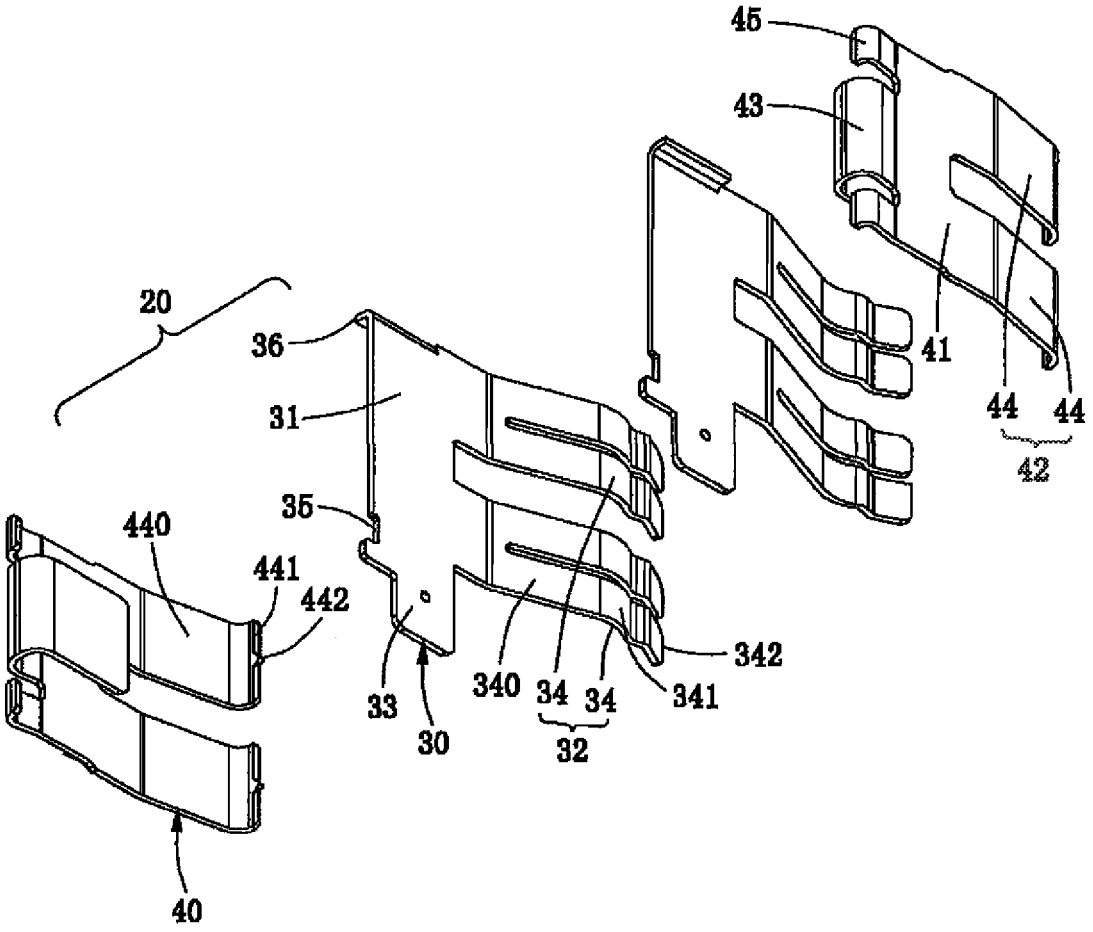
FIG. 8 is a perspective schematic view of a terminal assembly shown in FIG. 4 after disassembling.

Please refer to FIGS. 7 and 8, each terminal assembly 20 includes a conductive terminal 30 and a reinforcing terminal 40.

Please refer to FIGS. 7 and 8, the conductive terminal 30 includes a plate-shaped main body 31, a flexible engaging portion 32 bended from a front edge of the plate-shaped main body 31 and extending forward, and a mounting end 33 located at a lower edge of the plate-shaped main body 31. In this embodiment, the flexible engaging portion 32 includes two pairs of elastic pieces 34, which are spaced upper and lower and extend forward. Each elastic piece 34 has an inclined extension part 340 bended toward the other conductive terminal 30 from the front edge of the plate-shaped main body 31, an arc protruding part 341 bended far away the other conductive terminal 30 from the inclined extension part 340, and a tail part 342 being far away the other conductive terminal 30. More specifically, each elastic piece 34 is made by many bends. Therefore, the flexible engaging portion 32 has multiple bends. For example, the arc protruding part 341 is one of the bends. In this embodiment, the mounting end 33 is an upright plate, which vertically extends downward from the lower edge of the plate-shaped main body 31. Of course, in other embodiments, the mounting end 33 may be bended into an L type according to need.

Moreover, as shown in FIGS. 7 and 8, the conductive terminal 30 further includes a notch 35, which is formed on a rear edge of the plate-shaped main body 31 and located near the mounting end 33. The conductive terminal 30 further includes a horizontal holding plate 36 bended toward outside from an upper edge of the plate-shaped main body 31.

As shown in FIGS. 7 and 8, the reinforcing terminal 40 includes an upright portion 41, a pressing portion 42 bended from a front edge of the upright portion 41 and extending forward, and a latching portion 43 bended from a rear edge of the upright portion 41. In this embodiment, the latching portion 43 is U shaped, and the pressing portion 42 is L shaped. The pressing portion 42 includes two L-shaped plates 44, which are spaced upper and lower and extend forward. Each L-shaped plate 44 has an extension arm 440 bended toward the conductive terminal 30 from the front edge of the upright portion 41, an end part 441 vertically pointing at the conductive terminal 30, and a tip 442 formed on the end part 441. Moreover, the reinforcing terminal 40 further includes two catching portions 45, which are vertically bended from the rear edge of the upright portion 41 and are symmetrically located on upper and lower sides of the latching portion 43.

As shown in FIG. 5, when the reinforcing terminal 40 and the conductive terminal 30 are combined together, the upright portion 41 of the reinforcing terminal 40 is attached to an outer side of the plate-shaped main body 31 of the conductive terminal 30. The out side surface is the side which is far from the other conductive terminal 30. The latching portion 43 of the reinforcing terminal 40 is located at an inner side of the plate-shaped main body 31 of the conductive terminal 30. The inner side is the side which is close to the other conductive terminal 30. The pressing portion 42 presses the flexible engaging portion 32 of the conductive terminal 30. Furthermore, the end part 441 of the extension arm 440 of the reinforcing terminal 40 presses a concave side of the arc protruding part 341 of the conductive terminal 30. Further, as shown in FIG. 4, the two catching portions 45 of the reinforcing terminal 40 are held on the rear edge of the plate-shaped main body 31 of the conductive terminal 30.

As shown in FIG. 5, the plate-shaped main bodies 31 of the two conductive terminals 30 are arranged in parallel. The tail parts 342 of the flexible engaging portions 32 constitute a trumpet shape to be convenient for a smooth insertion of a butt connector 9. The arc protruding parts 341 of the flexible engaging portions 32 constitute a converged shape, but form a space therebetween. The two reinforcing terminals 40 are separately disposed the outer sides of the two conductive terminals 30. The pressing portions 42 of the two reinforcing terminals 40 can clamp the flexible engaging portions 32 of the two conductive terminals 30 to provide a reinforcing function for the two conductive terminals 30.

The following text will take one terminal assembly 20 as an example to describe the assembly relationship of the terminal assembly 20 and the base 10.

Please refer to FIGS. 1 and 3, when the terminal assembly 20 is mounted on the base 10, the conductive terminal 30 is mounted in the terminal-receiving passage 14 of the base 10. In detail, the plate-shaped main body 31 (the numeral 31 shown in FIG. 7) is located in the mounting portion 12 of the base 10, the horizontal holding plate 36 (the numeral 36 shown in FIG. 7) is held in the holding groove 18 of the base 10, the flexible engaging portion 32 extends into the engaging portion 11 of the base 10 and enters into the insertion opening 13 to be ready for being mated with the butt connector 9 shown in FIG. 5. Specifically, the two pairs of the elastic pieces 34 of the conductive terminal 30 separately enter from upper and lower sides of the cross beam 16 (the numeral 16 seen in FIG. 6) into the engaging portion 11 and straddle the cross beam 16. The shoulder 162 (shown in FIG. 6) of the cross beam 16 can ensure the conductive terminal 30 to be normally inserted into the terminal-receiving passage 14 and prevent the excessive forward insertion of the conductive terminal 30. The arc protruding parts 341 of the two pairs of the elastic pieces 34 protrude into the insertion opening 13. The mounting end 33 of the conductive terminal 30 extends out of the base 10 from the bottom surface of the base. Simultaneously, the hook-shaped free end 171 of the retaining arm 17 located at the bottom surface of the base 10 is engaged with the notch 35 (shown in FIG. 7) of the conductive terminal 30 to prevent the conductive terminal 30 from being detached from the base 10. Moreover, the reinforcing terminal 40 can enter into the terminal-receiving passage 14 together with the conductive terminal 30, wherein the latching portion 43 surrounds the rear section 161 (seen in FIG. 6) of the cross beam 16 to ensure the reinforcing terminal 40 being closely attached on the conductive terminal 30.

As described above, the electrical power connector 1 of the present invention employs the conductive terminal 30 having good elastic and the reinforcing terminal 40 attached on the conductive terminal 30. Because the pressing portion 42 of the reinforcing terminal 40 can press the flexible engaging portion 32 of the conductive terminal 30, there forms a larger electrical contact force between the electrical power connector 1 and the butt connector 9 to provide a high conductivity. It can be seen that the terminal assembly 20 of the present invention can provide a better electrical performance and a long term reliable connection. Further, because the electrical power connector 1 employs two separate terminal assemblies 20, which can use two kinds of different polarity currents, to expand the use range of the electrical power connector 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical power connector, comprising:

a base, including an engaging portion located at the front thereof, a mounting portion located at the rear thereof, an upright insertion opening formed on the engaging portion, and two terminal-receiving passages symmetrically located on two sides of the insertion opening to be communicated with the insertion opening and extend to a rear surface of the mounting portion; and at least two terminal assemblies being symmetrically mounted in the corresponding terminal-receiving passages of the base; each terminal assembly including:

a conductive terminal having a plate-shaped main body, a flexible engaging portion bended from a front edge of the plate-shaped main body and extending forward, and a mounting end located at a lower edge of the plate-shaped main body; wherein the plate-shaped main body is mounted in the mounting portion, the flexible engaging portion being inserted into the insertion opening from the corresponding terminal-receiving passage, and the mounting end extending out of a bottom surface of the base from the corresponding terminal-receiving passage; and a reinforcing terminal having an upright portion, a pressing portion bended from a front edge of the upright portion and extending forward, and a latching portion bended from a rear edge of the upright portion; wherein the upright portion is attached to one side of the plate-shaped main body of the conductive terminal, the latching portion being located at the other side of the plate-shaped main body of the conductive terminal, and the pressing portion pressing the flexible engaging portion of the conductive terminal.

2. The electrical power connector as claimed in claim 1, wherein the base further includes two cross beams, which are symmetrically located on the two sides of the insertion opening and are separately disposed in the corresponding terminal-receiving passages to divide the corresponding terminal-receiving passages into upper and lower parts; and each cross beam includes a front section located at the engaging portion and extending to a front surface of the engaging portion, a rear section located at the mounting portion, and two shoulders formed on left and right sides of the rear section.

3. The electrical power connector as claimed in claim 2, wherein the flexible engaging portion of the conductive terminal includes two pairs of elastic pieces, which are spaced upper and lower and extend forward and each of which has an inclined extension part bended toward the other conductive terminal from the front edge of the plate-shaped main body, an arc protruding part bended far away the other conductive terminal from the inclined extension part, and a tail part being far away the other conductive terminal; and the two pairs of the elastic pieces separately enter from upper and lower sides of the cross beam into the engaging portion of the base.

4. The electrical power connector as claimed in claim 3, wherein the plate-shaped main bodies of the two conductive terminals are arranged in parallel; the tail parts of the two conductive terminals constitute a trumpet shape; the arc protruding parts of the two conductive terminals constitute a converged shape and form a space therebetween; and the pressing portions of the two reinforcing terminals clamp the arc protruding parts of the two conductive terminals.

5. The electrical power connector as claimed in claim 3, wherein the latching portion is U shaped to surround the rear section of the cross beam; and the pressing portion is L shaped and includes two L-shaped plates, which are spaced upper and lower and extend forward, and each of which has an extension arm bended toward the conductive terminal from the front edge of the upright portion, an end part vertically pointing at the conductive terminal, and a tip formed on the end part; the end part presses a concave side of the arc protruding part of the conductive terminal.

6. The electrical power connector as claimed in claim 1, wherein the reinforcing terminal further includes two catching portions, which are vertically bended from the rear edge of the upright portion and are symmetrically located on upper and lower sides of the latching portion.

7. The electrical power connector as claimed in claim 1, wherein the base further includes two retaining arms, which are symmetrically disposed at the bottom surface of the mounting portion and each of which has a fixed end and a free end; the fixed end is fixed on the base, and the free end horizontally extends toward the rear surface of the mounting portion and forms to be hook-shaped;

each conductive terminal further includes a notch, which is formed on a rear edge of the plate-shaped main body and located near the mounting end; and the free ends of the two retaining arms of the base are engaged with the corresponding notches of the conductive terminals.

8. The electrical power connector as claimed in claim 1, wherein the base further includes two holding grooves, which are symmetrically disposed at the mounting portion and separately located on side walls of the two terminal-receiving passages and near top walls thereof; and the conductive terminal further includes a horizontal holding plate bended toward outside from an upper edge of the plate-shaped main body; and the horizontal holding plate is held in the corresponding holding groove.

9. The electrical power connector as claimed in claim 1, wherein a front surface of the engaging portion is perpendicular to the bottom surface of the mounting portion; the insertion opening extends rearward from the front surface of the engaging portion and passes though upper and lower surface of the engaging surface; each terminal-receiving passage passes through the front surface of the engaging portion and the rear surface of the mounting portion; and the base further includes at least two windows, which are located on the two sides of the insertion opening; and the insertion opening is communicated with the terminal-receiving passages by the two windows.

10. A terminal assembly, which is applied to an electrical power connector, comprising:

a conductive terminal having a plate-shaped main body, a flexible engaging portion bended from a front edge of the plate-shaped main body and extending forward, and a mounting end located at a lower edge of the plate-shaped main body; wherein the flexible engaging portion includes two pairs of elastic pieces, which are spaced upper and lower and extend forward; each elastic piece at least having an inclined extension part bended toward one side of the elastic piece from the font edge of the plate-shaped main body, an arc protruding part bended toward the other side thereof from the inclined extension part, and a tail part; and a reinforcing terminal having an upright portion, an L-shaped pressing portion bended from a front edge of the upright portion and extending forward, and an U-shaped latching portion bended from a rear edge of the upright portion; wherein the L-shaped pressing portion includes two L-shaped plates, which are spaced upper and lower and extend forward; and each L-shaped plate having an extension arm bended toward the conductive terminal from the front edge of the upright portion, and an end part vertically pointing at the conductive terminal;

wherein the upright portion is attached to one side of the plate-shaped main body of the conductive terminal, the latching portion is located at the other side of the plate-shaped main body of the conductive terminal, and the end part presses a concave side of the arc protruding part of the conductive terminal.

* * * * *